US005655586A

United States Patent [19]

Cattaneo

[11] Patent Number: 5,655,586

[45] Date of Patent: Aug. 12, 1997

[54] UNIVERSAL SUPPORT MEANS FOR THE SIDE GUIDES OF A ROLLING SHUTTER

[75] Inventor: Rino Cattaneo, Mezzago, Italy

[73] Assignee: I.M.B.A.C. S.p.A., Mezzago, Italy

[21] Appl. No.: 347,060

[22] Filed: Nov. 30, 1994

[30] Foreign Application Priority Data

Mar. 7, 1994 [IT] Italy ..... MI940159 U

[51] Int. Cl.[6] ..... E06B 9/00

[52] U.S. Cl. ..... 160/19; 160/323.1; 160/903

[58] Field of Search ..... 160/19, 23.1, 26, 160/29, 30, 31, 38, 32, 33, 268.1, 271, 272, 273.1, 133, 323.1, 903

[56] References Cited

U.S. PATENT DOCUMENTS

| | | | |
|---|---|---|---|
| 1,933,728 | 11/1933 | Gill et al. | 160/23.1 |
| 4,197,896 | 4/1980 | Reichstadt | 160/26 X |
| 4,234,032 | 11/1980 | Stark . | |
| 4,726,409 | 2/1988 | Besler | 160/23.1 |
| 4,930,563 | 6/1990 | Finch et al. | 160/271 |
| 4,944,341 | 7/1990 | Trippner et al. | 160/31 X |
| 5,067,540 | 11/1991 | Besler | 160/23.1 X |
| 5,070,925 | 12/1991 | Paule | 160/23.1 X |
| 5,474,117 | 12/1995 | Henkenjohann | 160/133 |

FOREIGN PATENT DOCUMENTS 0330806 2/1988 European Pat. Off. .

*Primary Examiner*—David M. Purol
*Attorney, Agent, or Firm*—Abelman, Frayne & Schwab

[57] ABSTRACT

Universal supports for the side guides of a rolling shutter include a tang (4,4') fixed to the rear end (2) of the base (3) of each flank (1,1') of the rolling shutter box and a plurality of different interchangeable stems (7,7') engageable at one end with the rolling shutter side guides and at the other end (9,9') with-the tang (4,4').

6 Claims, 2 Drawing Sheets

UNIVERSAL SUPPORT MEANS FOR THE SIDE GUIDES OF A ROLLING SHUTTER

BACKGROUND OF THE INVENTION

1. Field of the Invention

The present invention relates to universal support means for the side guides of a rolling shutter.

Specifically the present invention relates to universal support means for the side guides of a rolling shutter provided with an interchangeable removable side engagement stem.

2. Description of the Prior Art

As is known, rolling shutters, also termed rolling gates, comprise an undulated or articulated closing element which wraps on a shaft or axle running on side guides arranged in a box. Support means for guiding and running are employed to support the side guides on each side of the box.

In known support means for rolling shutter guidance and running, the boxes exhibit metallic or plastic flanks for support of the structures and are provided with long tangs which extend downward and constitute the constraint means to the rolling shutter side guides.

The tangs are integrated with corresponding flanks but, while being in themselves effective from the functional viewpoint of the boxes and associated rolling shutters, have some basic shortcomings.

In particular, their extension in relation to the substantially regular quadrangular configuration of only the flanks constitutes an impediment to assembly, with regard to packing and with regard to their fragility and the possibility of breakage with detachment of said tangs. Another shortcoming of the known tangs is their lack of interchangeability leading to the consequence that, for different configurations of rolling shutter guides, said tangs must be diversified.

Basically, at present interchangeability is not possible except by entirely replacing the flanks with related extended tangs.

Said shortcomings involve obvious and excessive waste of material, packing and capital and the employment of awkward and cumbersome storehouses.

The purpose of the present invention is to eliminate the above shortcomings.

SUMMARY OF THE INVENTION

In the more general aspect of the present invention this and other purposes are achieved by providing each flank of the box with a side guide support means comprising a removable and interchangeable side engagement stem.

The side guide support means of the present invention comprises a slightly projecting tang fixed to the rear end of the base of each flank of the box and provided with attachment means and a plurality of interchangeable stems, each having one end different from the other and engageable in the corresponding side guide for rolling shutters and for associated control members and a uniform opposing end engageable to said tang attachment means.

The flanks of the boxes are placed opposite to each other at the ends of the recesses designed for them and display their respective tangs aligned with the position corresponding with the running axle of the rolling shutters which unwind from and wind up on their respective drums.

On said tangs are engaged two supporting stems engageable in the corresponding side guides in which the rolling shutters run.

The advantages achieved by means of the support means of the present invention are varied and include, for example:

- each flank of the box and the corresponding side stem for connection to the guides for the rolling shutters and for the controls are separate from each other and are constrainable by mechanical means upon installation,
- the flank is basically configured in accordance with a structure of the so-called universal type, i.e., it is designed to be used in its standard configuration,
- the side stem constrainable to the flank can be designed in different configurations and is interchangeable depending on the type of side guide used for the door or window frame, and
- the component parts, flanks and stems are separate from each other and are easier to handle individually in regard to packing, transport, storage and manufacturing and provide considerable advantages from the installation viewpoint because of the interchangeability of the stems, types, sizes, lengths and different configurations.

BRIEF DESCRIPTION OF THE DRAWINGS

To better understand the present invention, it is described in greater detail below with reference to the figures in the annexed drawings representing embodiments given only by way of nonlimiting example wherein.

DESCRIPTION OF THE PREFERRED EMBODIMENTS

With reference to the figures, the flank (1,1') of a rolling shutter box has a substantially quadrangular configuration and comprises a base (3) and fixing holes.

The rear end (2) of its base (3) is provided with a projecting tang (4,4') extending in a limited manner from said base (3) so that the quadrangular configuration of the flank (1,1') is substantially preserved and remains easy to handle, pack and store and is also strong and protected from accidental breakage.

Figure 1:
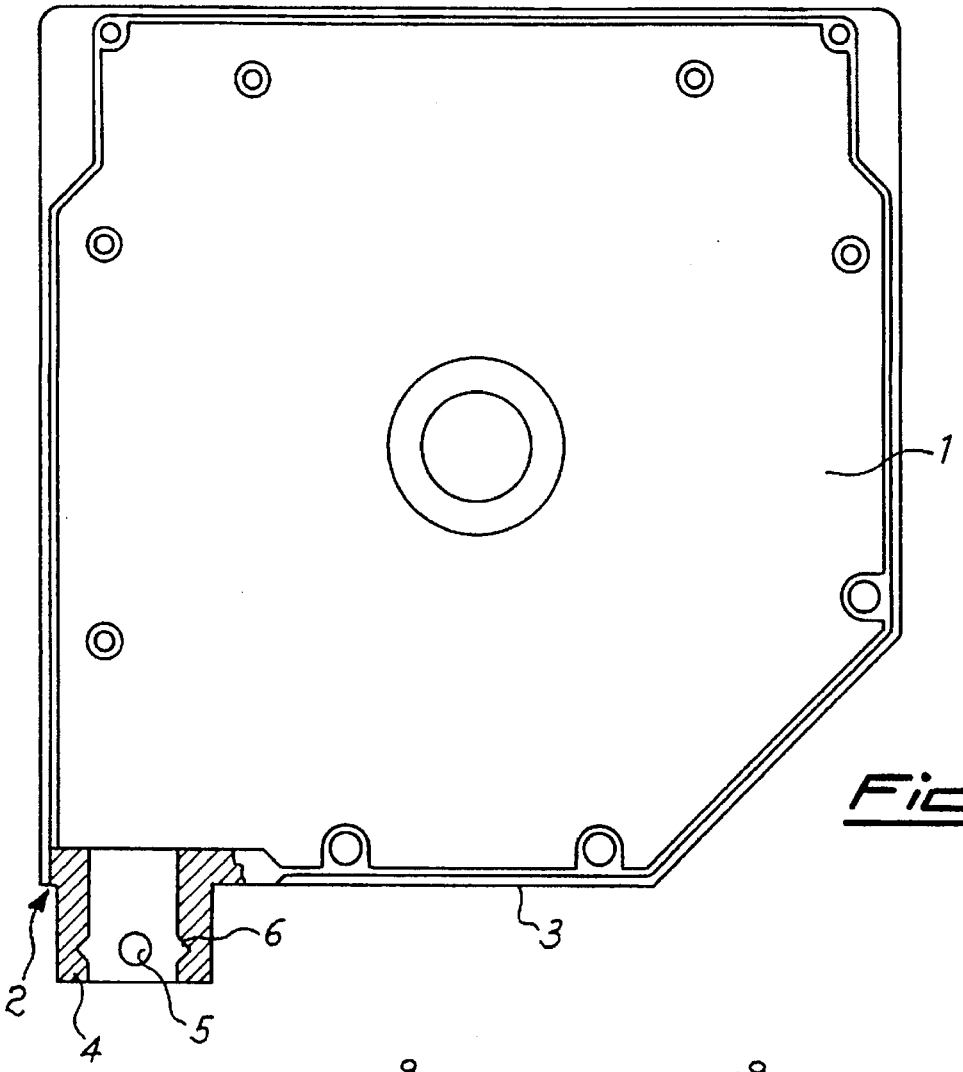
FIG. 1 shows a side view of a flank of the box provided with a short tang according to a first embodiment of the invention.
Figure 2A:
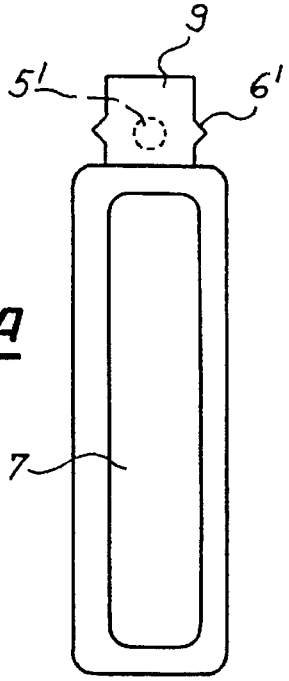
FIGS. 2A and 2B represent a front and a side view respectively of an example of an interchangeable stem according to the first embodiment of the invention.
Figure 2B:
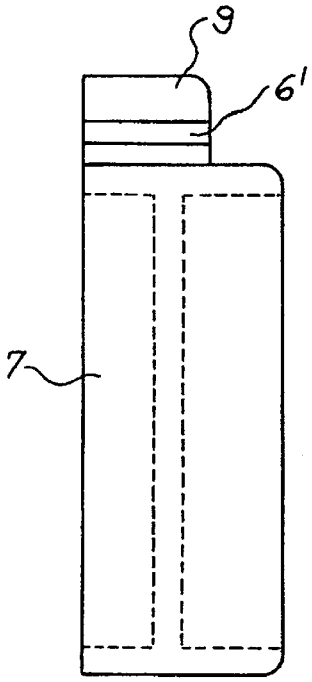

As shown in FIGS. 1, 2A, and 2B, the tang (4) can comprise transverse depressions (6) for pressure attachment and other constraint means such as pins (5) or the like.

The tang (4) can be coupled and constrained by means of the depressions (6) or pins (5) engaging protrusions (6') or holes (5') in the upper end (9) of an interchangeable stem (7) which can be provided in any size or length.

Figure 3:
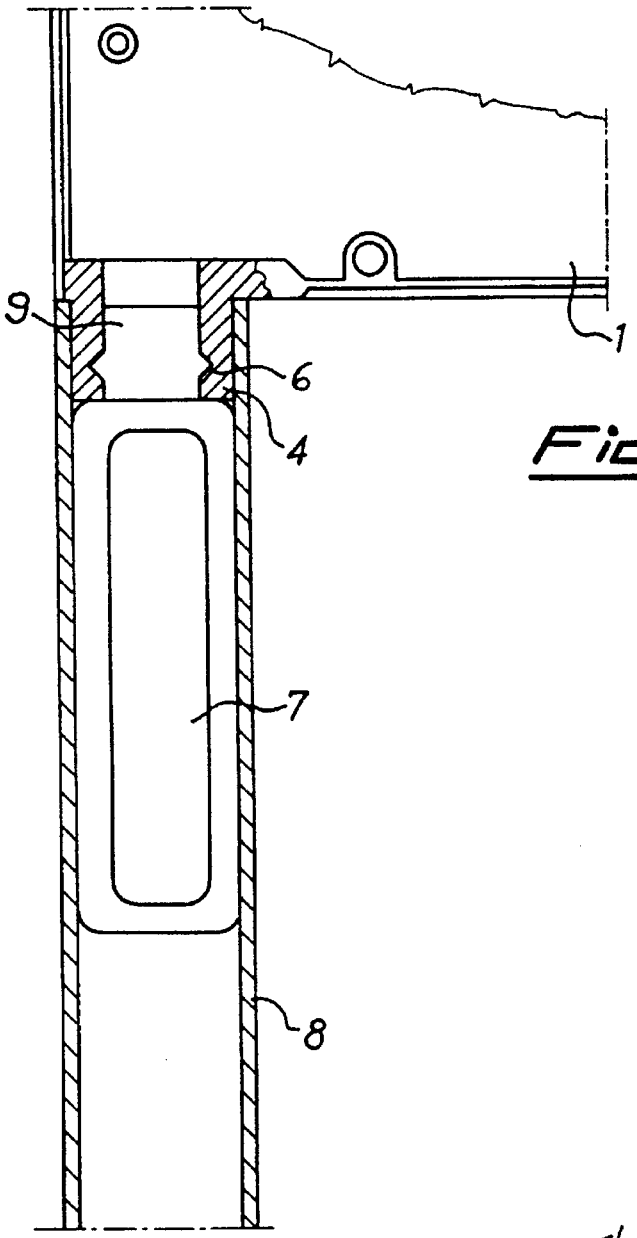
FIG. 3 shows a side view of a stem constrained to the respective tang according to a second embodiment of the invention.

The embodiment in FIG. 3 differs from that shown in FIGS. 1, 2A, and 2B only insofar as no pins (5) or holes (5') are present.

Figure 4:
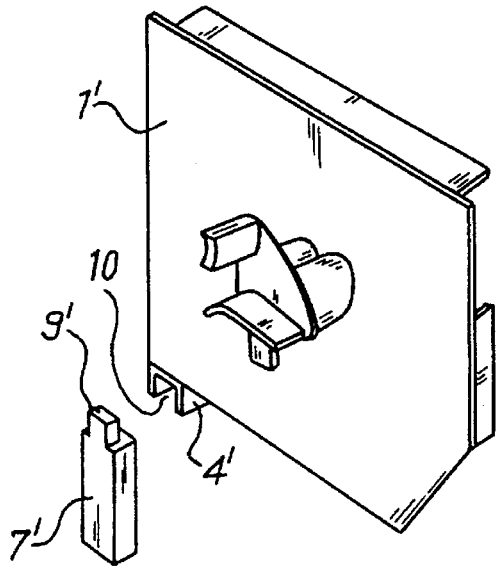
FIG. 4 shows a schematic view of a flank of the box provided with a short tang and a constrained stem according to a third embodiment of the invention.

The embodiment in FIG. 4 is an alternative to those embodiments shown in FIGS. 1, 2A, and 2B, and FIG. 3. In FIG. 4, the flank (1') has a tang (4') with straight inner surfaces (10) to engage a block shaped upper end (9') of an interchangeable stem (7').

Basically the flank (1,1') takes on a so-called universal configuration and can be used for various types of rolling shutter boxes with associated running guides.

The universal support means of the present invention comprises a plurality of stems (7,7').

Each stem (7,7') has an end (9,9') equal in form and size while the opposite end has a configuration different from the other and such as to engage in the side guide (8) of the rolling shutter. The stems (7,7') can be of different sizes and/or lengths.

In each window or door recess, at the upper ends are arranged two opposing aligned flanks (1,1') meaning that the respective tangs (4,4') project from the same side of the flanks (1,1') and constitute the couplings for the upper ends (9,9') of the stems (7,7').

Said stems engage in the side guides (8) of the rolling shutters and the associated operating controls.

In this manner the same type of flanks (1,1') with tangs (4,4') for any type of rolling shutter is made adaptable only by replacement of the side stems (7,7') which, being of a simpler configuration, are easier, faster and more economical to manufacture.

In addition, because of the smaller dimensions, the flanks (1,1') in their universal configuration and the stems (7,7') in their varied forms, sizes and lengths are simpler to manufacture, package and pack and facilitate storage, transportation and installation, regardless of the type of rolling shutter to be installed.

While the present invention has been described and explained by way of detailed embodiments it will be appreciated that various substitutions or equivalents may be made without departing from the spirit and scope of the invention as set forth in the claims.

I claim:

1. Universal support means guides (8) of a rolling shutter, said rolling shutter being arranged in a box, said box comprising two flanks (1,1') and a base (3), said universal support means comprising a tang (4,4') fixed to a rear end (2) of the base (3) of base flank (1) of the box and slightly projecting from said rear end (2), said tang (4,4') being provided with constraint means (5,6,10), said universal support means further comprising a plurality of interchangeable side stems (7,7'), each of said side stem (7,7') having an upper end (9,9') and a lower end, said upper end (9,9') being engageable with said constraint means (5,6,10), said lower end of each of said side stem (7,7') having a different form than the forms of all of said lower ends of the remainder of said side stems (7,7'), said lower end of each of said side stems (7,7') being engageable with a side guide (8) of a rolling shutter, said universal support means being characterized by the tang (4) being provided with pins (5), said upper end (9) of each of said side stems (7) being engageable with said pins (5).

2. Universal support mean for side guide (8) of a rolling shutter, said rolling shutter being arranged in a box, said box comprising two flanks (1,1') and a base (3), said universal support means comprising a tang (4,4') fixed to a rear end (2) of the base (3) of each flank (1) of the box and slightly projecting from said rear end (2), said tang (4,4') being provided with constraint means (5,6,10), said universal support means further comprising a plurality of interchangeable side stems (7,7'), each of said side stems (7,7') having an upper end (9,9') and a lower end, said upper end (9,9') being engageable with said constraint means (5,6,10), said lower end of each of said side stems (7,7') having a different form than the forms of all of said lower ends of the remainder of said side stems (7,7'), said lower end of each of said side stems (7,7') being engageable with a side guide (8) of a rolling shutter, said universal support means being characterized by the tang (4) being provided with transverse depressions (5), each of said side stems (7) being engageable in said depressions (5) at said upper end (9).

3. Universal support means in accordance with claim 2 in which each of said side stems (7,7') is provided with a distinct form and contour from the forms and contours of all of the other said side stems (7,7'), said form and contour being engageable with a distinct cross section of a side guide (8) of a rolling shutter.

4. Universal support means in accordance with claim 2 characterized by each flank (1,1') having a substantially quadrangular form, said tang (4,4') slightly projecting from said flank (1,1').

5. Universal support means in accordance with claim 2 characterized by said each of said side stems (7,7') having an identical upper end (9,9') and a lower end, said lower end being of different geometric configuration from the geometric configurations of all of the other lower ends of each of the remainder of said side stems (7,7') said lower end being engageable with a side guide (8) of a particular geometric configuration for rolling shutters.

6. Universal support means in accordance with claim 2 characterized by each of said side stems (7,7') having a different size and/or length from the size and/or length of all of the other of said side stems (7,7').

* * * * *